US010967631B2

(12) United States Patent
Harada

(10) Patent No.: US 10,967,631 B2
(45) Date of Patent: Apr. 6, 2021

(54) LIQUID EJECTION DEVICE, LIQUID EJECTION METHOD, AND COMPUTER-READABLE RECORDING MEDIUM

(71) Applicant: Yoshihiro Harada, Kanagawa (JP)

(72) Inventor: Yoshihiro Harada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/298,974

(22) Filed: Mar. 11, 2019

(65) Prior Publication Data

US 2019/0283400 A1 Sep. 19, 2019

(30) Foreign Application Priority Data

Mar. 19, 2018 (JP) ..... JP2018-051764

(51) Int. Cl.

| | |
|---|---|
| ***B41J 2/045*** | (2006.01) |
| ***B41J 11/00*** | (2006.01) |
| ***B41J 2/21*** | (2006.01) |
| ***B41J 29/393*** | (2006.01) |

(52) U.S. Cl.

CPC ..... *B41J 2/04508* (2013.01); *B41J 2/04581* (2013.01); *B41J 2/2114* (2013.01); *B41J 11/0015* (2013.01); *B41J 29/393* (2013.01); *B41J 2029/3935* (2013.01)

(58) Field of Classification Search

CPC .. B41J 2/04508; B41J 2/04581; B41J 2/2114; B41J 11/0015; B41J 29/393; B41J 2029/3935

See application file for complete search history.

(56) References Cited

U.S. PATENT DOCUMENTS

| | | | | |
|---|---|---|---|---|
| 6,474,778 | B1 * | 11/2002 | Koitabashi | B41J 2/2107 347/100 |
| 9,340,050 | B2 * | 5/2016 | Otani | B41J 2/195 |
| 2006/0158494 | A1 | 7/2006 | Yamanobe | |
| 2006/0203019 | A1 | 9/2006 | Yamanobe | |
| 2006/0203026 | A1 | 9/2006 | Inoue | |
| 2010/0208021 | A1 | 8/2010 | Hori | |

(Continued)

FOREIGN PATENT DOCUMENTS

| | | | |
|---|---|---|---|
| JP | 2000127375 | A | 5/2000 |
| JP | 2006124842 | A | 5/2006 |

(Continued)

OTHER PUBLICATIONS

European Search Report; Application EP19161874; dated Jul. 26, 2019.

*Primary Examiner* — Thinh H Nguyen

(74) *Attorney, Agent, or Firm* — Duft & Bornsen, PC

(57) ABSTRACT

According to an embodiment, a liquid ejection device that performs preprocessing to apply a processing liquid from an applying unit to a recording medium before ejecting a liquid droplet onto the recording medium to form an image, the liquid ejection device includes an acquiring unit and a correcting unit. The acquiring unit acquires a capture image that is of an image formed on the recording medium and that is captured by a capturing unit. The correcting unit corrects a state of the processing liquid applied by the applying unit based on a state of the liquid droplet indicated by the capture image.

9 Claims, 7 Drawing Sheets

(56) References Cited

U.S. PATENT DOCUMENTS

| | | | | |
|---|---|---|---|---|
| 2013/0155162 | A1* | 6/2013 | Ohtsuka | D06P 5/2011 347/102 |
| 2015/0035918 | A1 | 2/2015 | Matsumoto et al. | |
| 2016/0159108 | A1 | 6/2016 | Matsumoto et al. | |
| 2017/0320349 | A1 | 11/2017 | Matsumoto et al. | |

FOREIGN PATENT DOCUMENTS

| | | | |
|---|---|---|---|
| JP | 2006-248173 | | 9/2006 |
| JP | 2009241565 | A | 10/2009 |
| JP | 2010005996 | A | 1/2010 |
| JP | 2010043375 | A | 2/2010 |
| JP | 4942075 | | 3/2012 |
| JP | 2016-163998 | | 9/2016 |
| JP | 2016155349 | A | 9/2016 |

* cited by examiner

LIQUID EJECTION DEVICE, LIQUID EJECTION METHOD, AND COMPUTER-READABLE RECORDING MEDIUM

CROSS-REFERENCE TO RELATED APPLICATIONS

The present application claims priority under 35 U.S.C. § 119 to Japanese Patent Application No. 2018-051764, filed on Mar. 19, 2018. The contents of which are incorporated herein by reference in their entirety.

BACKGROUND OF THE INVENTION

1. Field of the Invention

The present invention relates to a liquid ejection device, a liquid ejection method, and a computer-readable recording medium.

2. Description of the Related Art

According to an image forming system using an inkjet recording system, after ink droplets having a predetermined size are ejected from an inkjet head, the ink droplets adhere to a recording medium so that ink dots having a predetermined size are formed, and then they are simultaneously and continuously arranged in a direction in two dimensions to form an image. For high-speed image formation, especially a one-path system is sometimes used, which uses a line head having a width corresponding to the page width of a recording medium. In the one-path system, however, deposition of adjacent ink dots in a short time interval and a flow between adjacent ink dots sometimes cause a degradation in the image quality such as beading or bleeding. This problem may occur not only in a one-path system but also in a serial system.

To achieve both a high speed and a high image quality in the above-described image forming system, in the technology disclosed in Japanese Unexamined Patent Application Publication No. 2016-163998, a preprocessing step is provided and performed on a recording medium. The preprocessing includes, for example, processing to apply an undercoat (hereafter, sometimes referred to as "processing liquid") and processing to perform plasma processing on the surface of a recording medium. The processing liquid contains at least a flocculant that aggregates dispersed ink pigments so that ink droplets adhering to a recording medium may be properly deposited and spread and quickly hardened, whereby adjacent ink droplets are unlikely to be mixed with each other. In the same manner, with regard to plasma processing, the surface of a recording medium is exposed to plasma, and the surface condition is chemically modified; thus, the similar effect as that of the processing liquid may be produced. With the provision of the above-described preprocessing step, the liquidity of ink droplets may be reduced immediately after the ink droplets adhere to a recording medium; thus, for high-speed image formation, clear images may be formed while a flow between adjacent ink droplets is prevented.

To form sufficiently clear images on various types of recording media, however, there is a need to execute control to perform appropriate preprocessing under each condition. For example, the process to apply an undercoat as disclosed in Japanese Unexamined Patent Application Publication No. 2016-163998 has a problem in that, as the quantity of undercoat to be applied is adjusted to obtain the quality of output images of more than a certain standard, there is a need to find an appropriate quantity of undercoat to be applied through trial and error with regard to a combination of a used ink and a recording medium.

In view of the above-described problem, there is a need to provide a liquid ejection device, a liquid ejection method, and a computer-readable recording medium having a program that make it possible to properly adjust the state of the processing liquid applied during preprocessing and form high-quality images.

SUMMARY OF THE INVENTION

According to an embodiment, there is provided a liquid ejection device that performs preprocessing to apply a processing liquid from an applying unit to a recording medium before ejecting a liquid droplet onto the recording medium to form an image. The liquid ejection device includes an acquiring unit and a correcting unit. The acquiring unit acquires a capture image that is of an image formed on the recording medium and that is captured by a capturing unit. The correcting unit corrects a state of the processing liquid applied by the applying unit based on a state of the liquid droplet indicated by the capture image.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
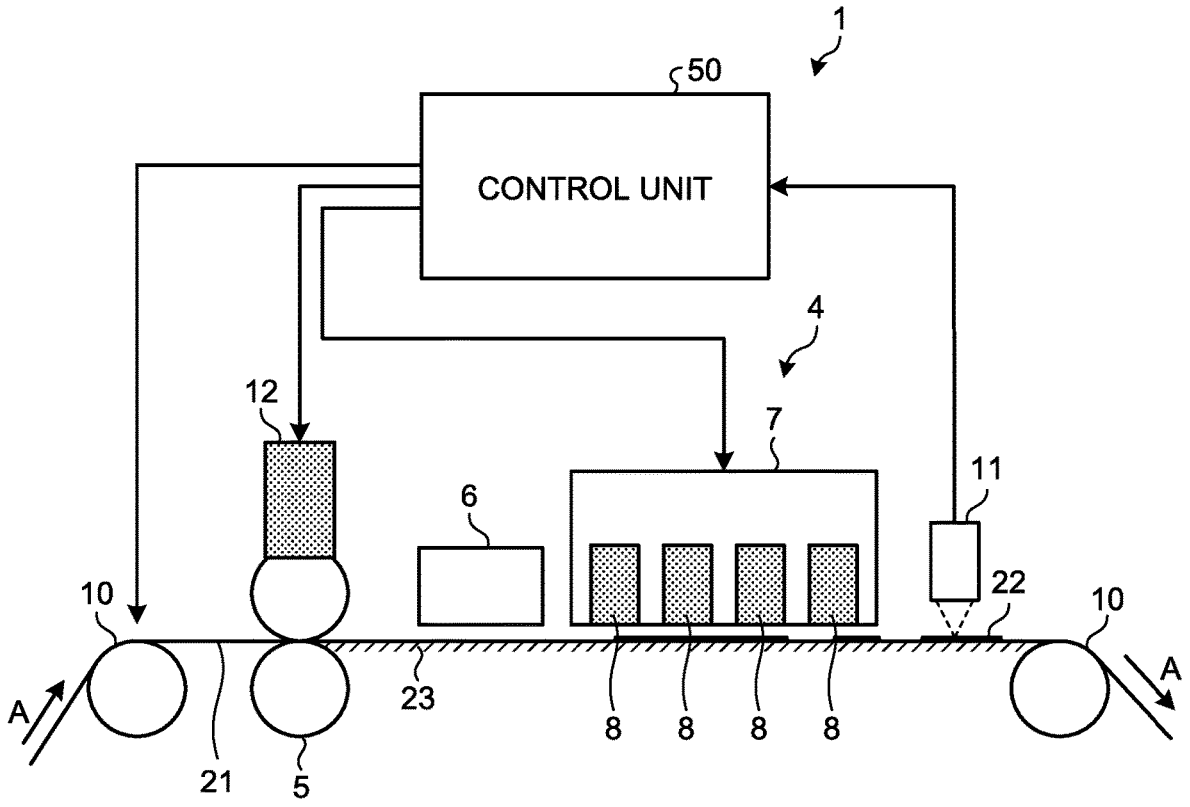
FIG. 1 is a diagram that illustrates an example of the configuration of the relevant part of an inkjet recording device according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

With reference to FIGS. 1 to 7, a detailed explanation is given below of an embodiment of a liquid ejection device, a liquid ejection method, and a computer-readable recording medium having a program according to the present invention. The present invention is not limited to the following embodiment, and components in the following embodiment include the ones that may be easily developed by a person skilled in the art, substantially the same ones, and the ones within what is called the range of equivalents. Furthermore, various types of omission, replacement, modification, and combination may be made to components without departing from the scope of the following embodiment.

Configuration of an Inkjet Recording Device

Figure 2A:
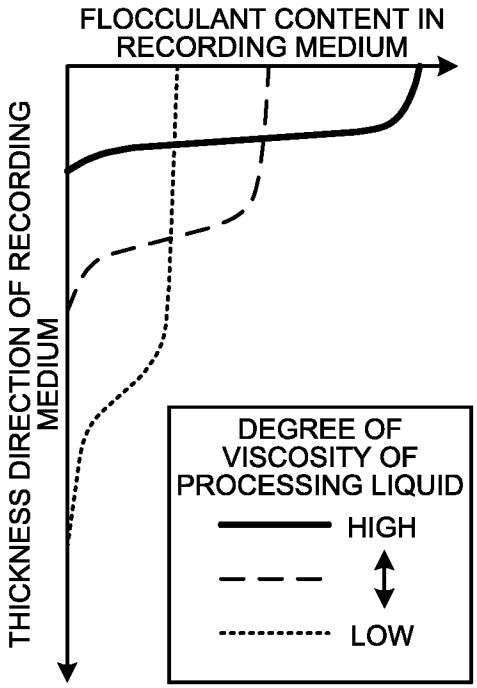
FIGS. 2A, 2B, and 2C are diagrams that illustrate an example of the flocculant distribution in a thickness direction of a recording medium.
Figure 2B:
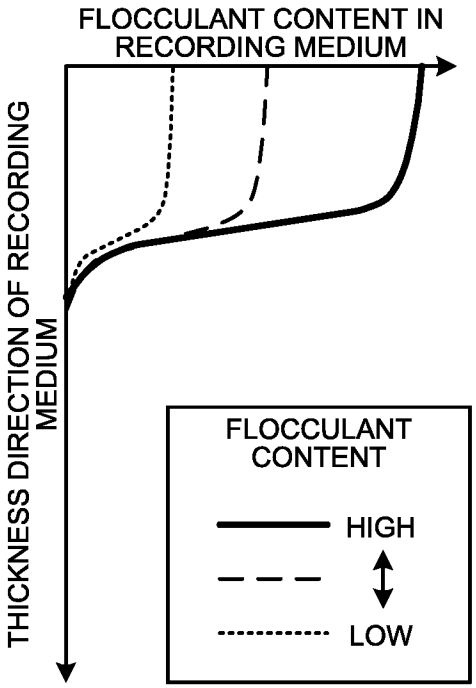
Figure 2C:
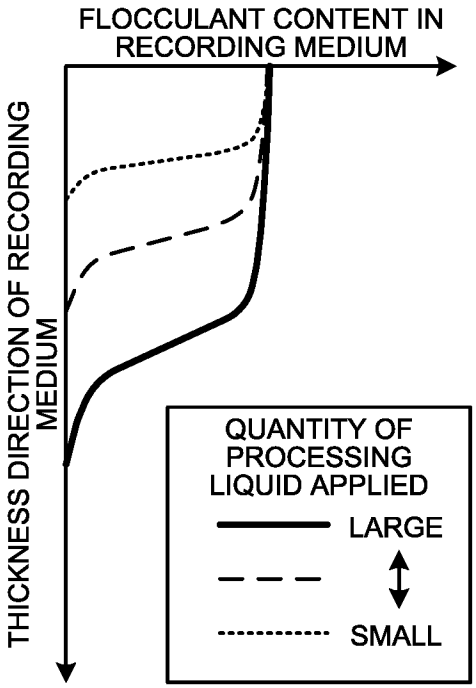

FIG. 1 is a diagram that illustrates an example of the configuration of the relevant part of an inkjet recording device according to an embodiment. FIGS. 2A, 2B, and 2C are diagrams that illustrate an example of the flocculant distribution in the thickness direction of a recording medium. The configuration of the relevant part of an inkjet recording device 1 according to the present embodiment is explained with reference to FIG. 1, and flocculant distributions in the thickness direction of a recording medium are explained with reference to FIGS. 2A, 2B, and 2C. In the explanation, the inkjet recording device 1 according to the present embodiment is a line head inkjet recording device, and it operates in a one-path system by conveying a roll-shaped recording medium with a rotary roller and forming images on the recording medium.

As illustrated in FIG. 1, the inkjet recording device (an example of a liquid ejection device) according to the present embodiment includes an image forming unit 4, a rotary roller 10, a capturing unit 11, a processing-liquid adjusting unit 12, and a control unit 50.

The image forming unit 4 is a device that ejects ink onto a recording medium 21 to form an image. The image forming unit 4 includes a surface processing unit 5 (an example of an applying unit), a drying unit 6, and a head unit 7.

The surface processing unit 5 is a device located upstream of the head unit 7 in a conveying direction A of the recording medium 21 to apply a processing liquid 23 to the recording medium 21 as preprocessing for image forming processing. The surface processing unit 5 is disposed such that it crosses the recording medium 21 in its width direction. The processing liquid 23 for preprocessing contains a flocculant that has characteristics such that it reacts with adhering ink 22 to reduce the liquidity of liquid droplets of the ink 22 and makes the dispersed state of pigment particles in the ink 22 unstable and aggregate them. Due to this aggregation reaction of the flocculant, pigment particles in the ink 22 are aggregated, the particle diameter in appearance becomes large, the diffusion coefficient of pigment particles is reduced based on the Einstein-Stokes equation, and the liquidity of the ink 22 is decreased. Furthermore, the ink 22 may be any ink or liquid, such as ink containing a water-dispersible colorant, ultraviolet cure ink, or electron beam curable ink.

The quantity of the adhering processing liquid 23 per unit area of the recording medium 21 varies depending on physical properties, such as the type of the recording medium 21, the conveying speed, or the degree of viscosity of the processing liquid 23, the temperature, and the like. Furthermore, when the surface processing unit 5 is configured as a roll coater, the quantity of the adhering processing liquid 23 also varies depending on the gap between rolls or the applied pressure. Moreover, when the surface processing unit 5 is configured as an inkjet head, the quantity of the adhering processing liquid 23 also varies depending on the quantity of ejected liquid.

Furthermore, when the recording medium 21 is permeable due to fine pores provided on at least the surface thereof, or the like, all or part of the processing liquid 23 permeates the inside of the recording medium 21 (permeable medium) after adhering to the recording medium 21. When the size of a flocculant particle included in the processing liquid 23 is sufficiently smaller than the size of a fine pore, the flocculant gets permeated in accordance with permeation of the processing liquid 23, and the flocculant is fixed in the recording medium 21. Assume that a flocculant is unevenly distributed deep in the recording medium 21 and is fixed. After a liquid droplet of the ink 22 adheres to the recording medium 21, a solvent component of the ink 22 permeates the inside of the recording medium 21. When the depth of the permeation reaches the depth of the unevenly distributed flocculant, the flocculant fixed inside the recording medium 21 may diffuse into liquid droplets of the ink 22 through the solvent of the ink 22. That is, a reduction in the liquidity of liquid droplets of the ink 22 is delayed when the flocculant is present deep in the recording medium 21 as compared with a case where the flocculant is present only on the surface of the recording medium 21.

Next, with reference to FIGS. 2A, 2B, and 2C, an explanation is given of a flocculant distribution in the thickness direction of the recording medium 21 in accordance with changes in the state of the processing liquid 23 applied from the surface processing unit 5. FIG. 2A illustrates a behavior with regard to the flocculant distribution in the thickness direction of the recording medium 21 when the degree of viscosity of the processing liquid 23 is changed, FIG. 2B illustrates it when the flocculant content of the processing liquid 23 is changed, and FIG. 2C illustrates it when the quantity of the applied processing liquid 23 is changed.

As illustrated in FIG. 2A, as for the degree of viscosity of the processing liquid 23, a lower degree of viscosity of a liquid generally causes permeation to a deeper position, and a high degree of viscosity of the processing liquid 23 causes the flocculant inside the recording medium 21 to be concentrated in the vicinity of the surface of the recording medium 21, which results in a high flocculant concentration near the surface. Conversely, a low degree of viscosity of the processing liquid 23 causes distribution of the flocculant to a deep position in the recording medium 21 and a relatively low flocculant concentration near the surface of the recording medium 21.

As illustrated in FIG. 2B, as for the flocculant content of the processing liquid 23, the permeation depth does not change while the degree of viscosity of the processing liquid 23 is not changed. However, when the flocculant content of the processing liquid 23 is high, most of the flocculant is fixed in the recording medium 21, and the flocculant concentration near the surface of the recording medium 21 is high.

As illustrated in FIG. 2C, as for the quantity of the applied processing liquid 23, a higher quantity of the processing liquid 23 to be permeated causes permeation deeper into the recording medium 21 and a higher quantity of flocculant fixing in the recording medium 21. In the example illustrated in FIG. 2C, the flocculant concentration near the surface of the recording medium 21 is constant even when the quantity for application varies; however, it is illustrated by an example, and it may be sometimes inconstant depending on the types of the recording medium 21 and the processing liquid 23.

Thus, a flocculant distribution in the thickness direction of the recording medium 21 varies depending on the degree of viscosity, the flocculant content, and the quantity of the processing liquid 23 applied, and the like, and their differences affect the diffusing behavior of the flocculant into liquid droplets of the ink 22 adhering to the surface of the recording medium 21. Specifically, a flocculant fixed on the surface of the recording medium 21 diffuses into the ink 22 at a relatively early stage after adherence of a liquid droplet of the ink 22, and a flocculant fixed deep in the recording medium 21 diffuses into the ink 22 at a relatively late stage after adherence of a liquid droplet of the ink 22. As the diffusing behavior of the flocculant changes, a behavior of a reduction in the liquidity of a liquid droplet of the ink 22 also changes. Furthermore, when the quantity of flocculant fixed on the surface of the recording medium 21 is different, the apparent surface energy of the recording medium 21 is also different, and therefore the depositing and spreading behavior of a liquid droplet of the ink 22 is also affected.

The drying unit 6 is a device that dries a flocculant included in the processing liquid 23 applied to the recording medium 21 to fix it in the recording medium 21. After the recording medium 21 with the flocculant of the processing liquid 23 thus fixed therein is moved through the head unit 7, liquid droplets of the ink 22 adhere to the recording medium 21 with the flocculant attached thereto.

The head unit 7 is a device that ejects liquid droplets of the ink 22 toward the recording medium 21 to form images. In the head unit 7, an inkjet head 8 capable of ejecting at least one type of liquid droplets of the ink 22 is disposed such that it crosses the entire recording medium 21 in its width direction. Furthermore, to use multiple types of the ink 22 so as to form for example color images on the recording medium 21, the head unit 7 may be provided with the inkjet heads 8 side by side in the conveying direction A of the recording medium 21, as illustrated in FIG. 1. Moreover, the head unit 7 causes each of the inkjet heads 8 to eject a desired quantity of liquid droplets of the ink 22 for an image to be formed in synchronization with the conveying speed of the recording medium 21 and causes the liquid droplets to adhere to the recording medium 21, thereby forming an image after the subsequent ink drying process (not illustrated). Also, the flocculant fixed in the recording medium 21 enters a state such that it may diffuse into a liquid droplet of the ink 22 after adherence of the liquid droplet. After the flocculant diffuses into a liquid droplet of the ink 22, it aggregates pigment particles that are in a dispersed state inside the liquid droplet of the ink 22, whereby the liquidity of the liquid droplet of the ink 22 is reduced.

The rotary roller 10 is a member that conveys the sheet-like recording medium 21 in at least one direction (the conveying direction A). Furthermore, as long as the recording medium 21 is relatively sweepable by the surface processing unit 5 and the head unit 7, the recording medium 21 may be conveyed by a rotary drum, or the surface processing unit 5 and the head unit 7 may be swept (moved) above the recording medium 21. Furthermore, the recording medium 21 may be not only a roll-shaped medium (a roll of paper, or the like) but also for example a cut sheet, or a recording medium other than paper, such as wood.

The capturing unit 11 is a device that captures ink dots constituting an image formed by the head unit 7. The capturing unit 11 is located downstream of the head unit 7 in the conveying direction A of the recording medium 21. The capturing unit 11 may capture the entire surface of the recording medium 21 in the width direction or may include an undepicted slider movable in the width direction of the recording medium 21 to capture only the periphery of an ink dot at a desired position of the recording medium 21 as long as it is possible to determine the shape of an ink dot on the recording medium 21.

Furthermore, the capturing unit 11 may conduct capturing by using a method of executing exposure only before and after crossing of an ink dot in a linear capturing area with a line sensor or a method of executing exposure only in a moment when an ink dot passes through a planar capturing area with an area sensor. Moreover, as for the target image captured by the capturing unit 11, a prepared image for capturing the shape of an ink dot may be used, or the image to be formed may be used.

The processing-liquid adjusting unit 12 is a device that adjusts at least the degree of viscosity, the flocculant content, and the quantity of the processing liquid 23 applied by the surface processing unit 5. The degree of viscosity and the flocculant content of the processing liquid 23 are adjusted by, for example, mixing the multiple processing liquids 23 having two or more different types of degree of viscosity or mixing the processing liquid 23 with a solvent containing no flocculant. When the surface processing unit 5 is configured to apply the processing liquid 23 by using inkjet heads, the inkjet heads ejecting multiple types of the processing liquids 23 and a solvent containing no flocculant may be arranged to adjust at least the degree of viscosity, the flocculant content, and the quantity of the processing liquid 23 to be applied.

The control unit 50 is a device that controls the overall operation of the inkjet recording device 1. The specific configuration and function of the control unit 50 are described later with reference to FIGS. 3 and 4.

Figure 3:
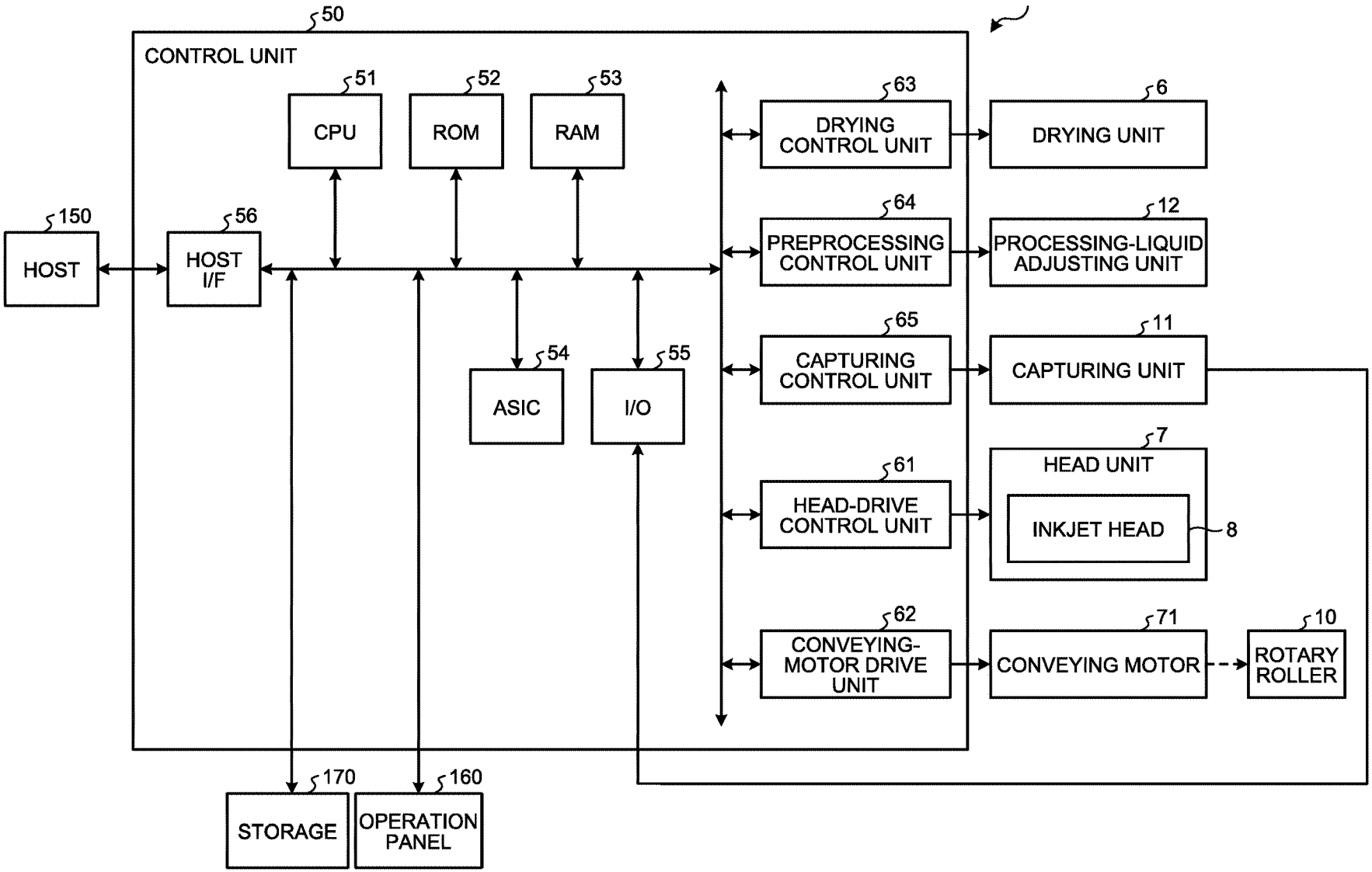
FIG. 3 is a diagram that illustrates an example of the hardware configuration of the inkjet recording device according to the embodiment.

Hardware configuration of the inkjet recording device FIG. 3 is a diagram that illustrates an example of the hardware configuration of the inkjet recording device according to the embodiment. With reference to FIG. 3, the hardware configuration of the inkjet recording device 1 according to the present embodiment is explained.

As illustrated in FIG. 3, the inkjet recording device 1 according to the present embodiment includes the control unit 50, a conveying motor 71, an operation panel 160, and a storage 170. Furthermore, as described above, the inkjet recording device 1 includes the drying unit 6, the head unit 7, the rotary roller 10, the capturing unit 11, and the processing-liquid adjusting unit 12.

As illustrated in FIG. 3, the control unit 50 includes a CPU (central processing unit) 51, a ROM (read only memory) 52, a RAM (random access memory) 53, an ASIC (application specific integrated circuit) 54, an I/O 55, a host I/F 56, a head-drive control unit 61, a conveying-motor drive unit 62, a drying control unit 63, a preprocessing control unit 64, and a capturing control unit 65.

The CPU 51 is an arithmetic device that controls the overall operation of the inkjet recording device 1. The ROM 52 is a nonvolatile memory that stores data and programs while the power of the inkjet recording device 1 is turned off. The RAM 53 is a volatile memory that functions as a work area for the CPU 51.

The ASIC 54 is an integrated circuit that performs various types of signal processing on image data or print data and image processing for rearrangement, or the like, or input/output signal processing for controlling the overall inkjet recording device 1.

The I/O 55 is an interface for inputting capture images that are captured by the capturing unit 11 and detection signals from various sensors, and the like. The host I/F 56 is an interface for transmitting and receiving data and signals to and from a host 150. The host I/F 56 is a network interface compatible with, for example, TCP (Transmission Control Protocol)/IP (Internet Protocol). Furthermore, the host I/F 56 may be an interface such as USB (Universal Serial Bus). The host 150 connected to the host I/F 56 may include, for example, an information processing apparatus such as a PC (personal computer), an image reading device such as an image scanner, or an imaging device such as a digital camera.

The head-drive control unit 61 controls driving of the inkjet head 8 in the head unit 7. The head-drive control unit 61 transmits image data as serial data to a drive circuit inside the head unit 7. Here, the head-drive control unit 61 generates transfer clocks and latch signals necessary for transferring image data, confirming transfer, and the like, and drive waveforms used to eject liquid droplets of ink from the head unit 7 and outputs them to the drive circuit inside the head unit 7. The drive circuit inside the head unit 7 selectively inputs the drive waveform corresponding to input image data to a piezoelectric element (actuator) of each nozzle of the inkjet head 8 in the head unit 7.

The conveying-motor drive unit 62 drives the conveying motor 71 under the control of the CPU 51. The conveying motor 71 is a motor that rotates the rotary roller 10 illustrated in FIG. 1 to convey the recording medium 21 in the conveying direction A.

The drying control unit 63 controls drying operation of the drying unit 6.

The preprocessing control unit 64 controls operation performed by the processing-liquid adjusting unit 12 to adjust the state of the processing liquid applied by the surface processing unit 5. Here, "the state of the applied processing liquid" represents the state of the processing liquid applied to the recording medium 21 by the surface processing unit 5, at least the degree of viscosity, the flocculant content, and the quantity for application. Furthermore, "the state of the applied processing liquid" represents the state of the processing liquid applied to the recording medium 21 after the process during which the processing liquid is applied to the recording medium 21 by the surface processing unit 5 and is dried by the drying unit 6.

The capturing control unit 65 controls capturing operation (capturing timing, or the like) of the capturing unit 11 to capture images formed by the head unit 7.

The operation panel 160 is a device having an input function and a display function, i.e., receiving various types of input corresponding to user's operations and displaying various types of information (e.g., information that corresponds to a received operation, information indicating an operation status of the inkjet recording device 1, or a setting screen). The operation panel 160 is configured by, for example, a liquid crystal display device (LCD) having a touch panel function installed therein. Furthermore, the operation panel 160 may be configured by not only a liquid crystal display device but also, for example, an organic EL (electro-luminescence) display device having a touch panel function installed therein. Furthermore, the operation panel 160 may be provided with an operating unit such as hardware keys or a display unit such as a lamp in addition to or instead of a touch panel function.

The storage 170 is a non-volatile storage device that stores image data, print data, setting information, programs, relation information described later, and the like. The storage 170 is, for example, an HDD (hard disk drive), SSD (solid state drive), or a flash memory.

The summary of operation performed by the inkjet recording device 1 having the above configuration is described. The control unit 50 receives print data, and the like, from the host 150 via the host I/F 56 and via a cable or a network. Then, the CPU 51 reads and analyzes print data in a receiver buffer included in the host I/F 56. Then, the ASIC 54 executes necessary image processing and data rearrangement processing, or the like, and transmits the processed data (image data) to the head unit 7 via the head-drive control unit 61.

Figure 4:
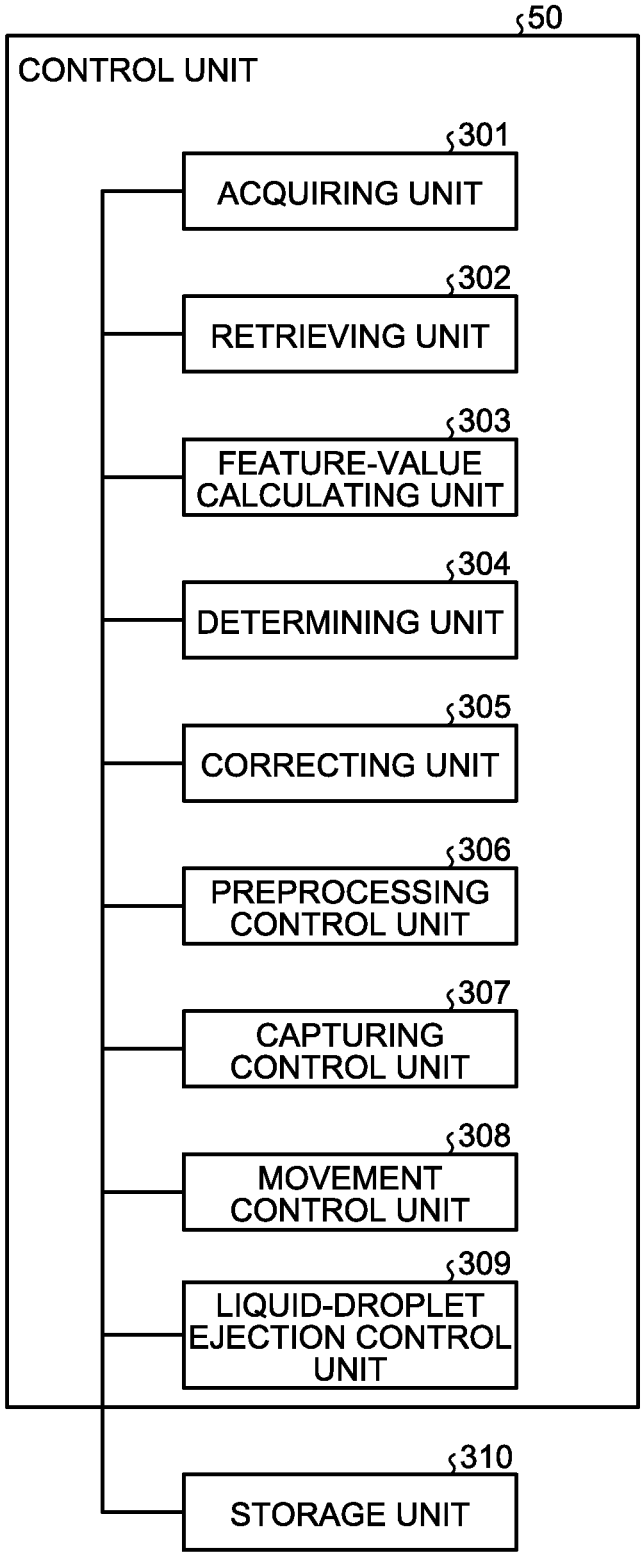
FIG. 4 is a diagram that illustrates an example of the configuration of the functional block of a control unit of the inkjet recording device according to the embodiment.
Figure 5:
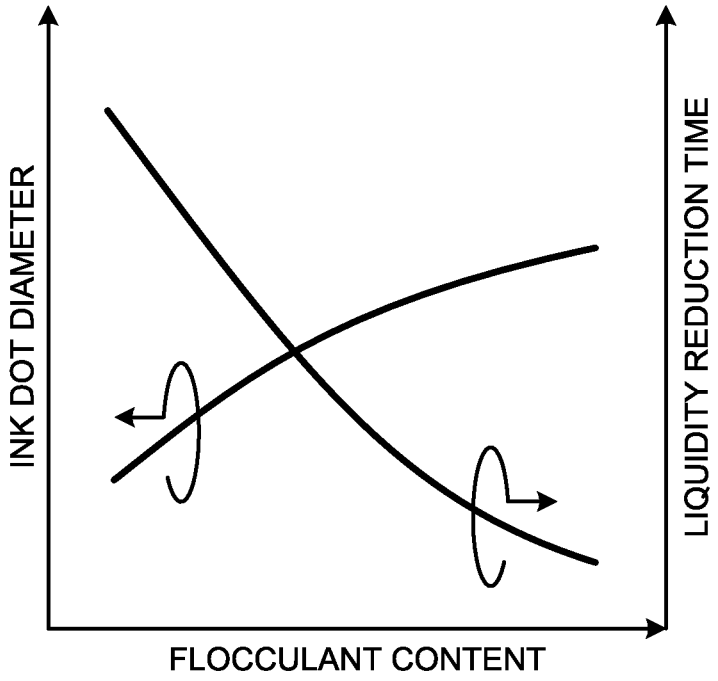
FIG. 5 is a diagram that illustrates an example of the relation among a concentration of a flocculant contained in the processing liquid, an ink dot diameter, and a liquidity reduction time.
Figure 6:
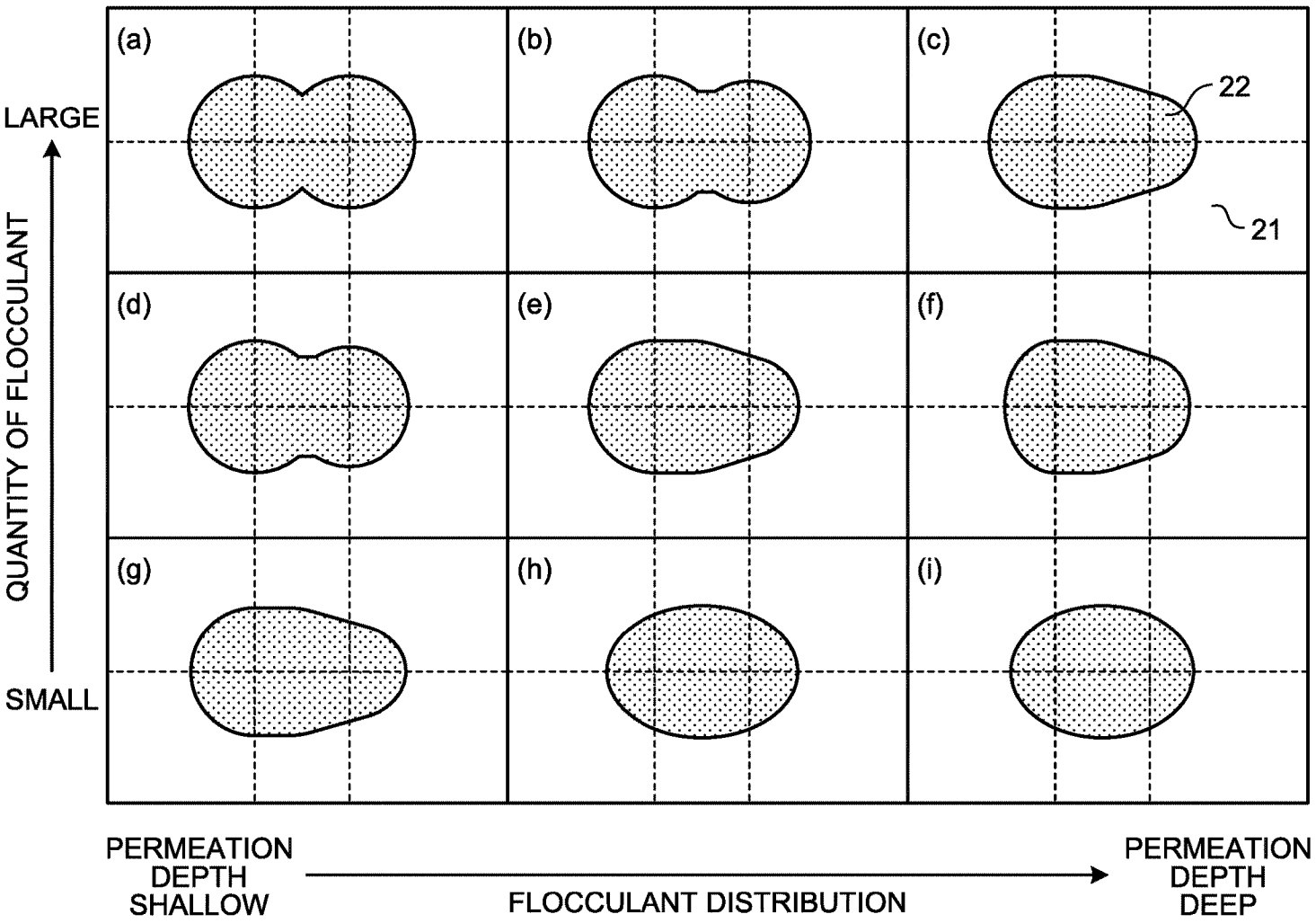
FIG. 6 is a diagram that illustrates an example of the relation among a flocculant distribution inside a recording medium, a quantity of flocculant, and a state of adjacent dots.

The hardware configuration of the inkjet recording device 1 illustrated in FIG. 3 is illustrated by an example; all the components illustrated in FIG. 3 do not need to be included, or other components may be included. Configuration and operation of the functional block of the control unit of the inkjet recording device FIG. 4 is a diagram that illustrates an example of the configuration of the functional block of the control unit of the inkjet recording device according to the embodiment. FIG. 5 is a diagram that illustrates an example of the relation among the concentration of a flocculant contained in the processing liquid, an ink dot diameter, and a liquidity reduction time. FIG. 6 is a diagram that illustrates an example of the relation among a flocculant distribution inside a recording medium, a quantity of flocculant, and a state of adjacent dots. With reference to FIGS. 4 to 6, the configuration and operation of the functional block of the control unit 50 in the inkjet recording device 1 according to the present embodiment are explained.

As illustrated in FIG. 4, the control unit 50 of the inkjet recording device 1 according to the present embodiment includes an acquiring unit 301, a retrieving unit 302, a feature-value calculating unit 303 (calculating unit), a determining unit 304, a correcting unit 305, a preprocessing control unit 306, a capturing control unit 307, a movement control unit 308, and a liquid-droplet ejection control unit 309. Furthermore, the inkjet recording device 1 includes a storage unit 310 outside the control unit 50.

The acquiring unit 301 is a functional unit that acquires, via the I/O 55, a capture image representing ink dots constituting an image that is formed by the head unit 7 and captured by the capturing unit 11. The acquiring unit 301 is implemented by using a program executed by the CPU 51 illustrated in for example FIG. 3.

The retrieving unit 302 is a functional unit that retrieves, from a capture image acquired by the acquiring unit 301, an area (hereafter, sometimes referred to as "single-dot area") formed of a single ink dot and an area (hereafter, sometimes referred to as "adjacent-dots area") where two adjacent ink dots are in contact with each other. The retrieving unit 302 is implemented by using a program executed by the CPU 51 illustrated in for example FIG. 3.

Here, an explanation is given of the relation among a flocculant content of the processing liquid 23, an ink dot diameter (the diameter of an ink dot represented by a single-dot area), and a liquidity reduction time, illustrated in FIG. 5. A flocculant is unevenly distributed and fixed near the surface of the recording medium 21, and the quantity thereof is larger as the concentration of the flocculant (flocculant content) contained in the processing liquid 23 is higher. In this case, the higher the flocculant content is, the faster the depositing and spreading speed of liquid droplets of the ink 22 adhering to the surface of the recording medium 21 is. As a result, the ink dot diameter is larger when the applied processing liquid 23 has a higher flocculant content which causes a larger quantity of flocculant, and the like, to be present near the surface of the recording medium 21. Furthermore, a liquidity reduction time of a liquid droplet of the ink 22 is affected by changes in the quantity of flocculant diffused into a liquid droplet of the ink 22. Furthermore, a liquidity reduction time of a liquid droplet of the ink 22 is also affected by the rate of permeation of a liquid droplet of the ink 22 into the recording medium 21 and the rate of evaporation of a solvent into air. With regard to changes in the quantity of diffused flocculant, the processing liquid 23 having a high flocculant content, which allows a large quantity of flocculant to be included in the recording medium 21, causes a large quantity of flocculant to be diffused in a short time, which results in a short liquidity reduction time. The relation among them varies depending on the physical or chemical properties of the processing liquid 23, the ink 22, and the recording medium 21.

Next, an explanation is given of the relation among the flocculant distribution and the quantity of flocculant in the recording medium 21 and the covered state of two adjacent ink dots (the covered state of two ink dots represented by an adjacent-dots area), illustrated in FIG. 6. In a one-path system, a time interval in which two adjacent liquid droplets of the ink 22 adhere to the recording medium 21 is generally shorter as an image printing speed is higher. After adhering to the recording medium 21 at the time interval, two liquid droplets of the ink 22 are brought into contact with each other after exhibiting their depositing and spreading behaviors. When at least any one of the two liquid droplets of the ink 22, after being in contact with each other, is in the process of depositing and spreading or the liquidity thereof is not sufficiently reduced, the two ink droplets interfere with each other in their behaviors and become one, which results in a change in their covered state.

As illustrated in for example a section (a) of FIG. 6, when a large quantity of flocculant is unevenly distributed near the surface of the recording medium 21, the depositing and spreading speed of liquid droplets of the ink 22 is high, and the liquidity reduction time is short; therefore, as each liquid droplet of the ink 22 quickly provides stability to its shape, they are less likely to interfere with each other, and they form dots such as two ink dots arranged side by side. Conversely, as illustrated in a section (i) of FIG. 6, when the recording medium 21 includes a small quantity of flocculant or there is a small quantity of flocculant near the surface of the recording medium 21 as the processing liquid 23 is permeated to a deep position, the depositing and spreading speed of a liquid droplet of the ink 22 is low, and a liquidity reduction time is long; thus, two ink droplets exhibit a behavior such as, after being in contact, interfering with each other and gathering as a single droplet. Here, the covered area of the two abutting ink dots on the recording medium 21 becomes small as there is a noticeable behavior of gathering as a single droplet and, as any one of the two liquid droplets of the ink 22 still has a high liquidity, the two liquid droplets of the ink 22 are mixed with each other. Part of an area, which is supposed to be covered with one droplet of the ink 22 on the recording medium 21, is likely to be uncovered due to the above-described behavior; therefore, microscopic dot defects easily occur in formed images, and the density is decreased when the processing liquid 23 is permeated deep into the recording medium 21 (i.e., the degree of viscosity of the processing liquid 23 is low), when the flocculant content of the processing liquid 23 is low, and when the quantity of the applied processing liquid 23 is small. Furthermore, as liquid droplets of the ink 22 having a high liquidity are brought into contact with each other, uneven distribution of microscopic pigment particles easily occurs in a formed image, which causes an uneven density and a decrease in clearness at a color boundary.

As described above, the state (e.g., an ink dot diameter) of a single ink dot (an example of the state of a liquid droplet, an example of the state of a single liquid droplet) explained in FIG. 5 and the state (e.g., size, shape, or mixed state) of two adjacent ink dots (an example of the state of a liquid droplet, an example of the state of two adjacent liquid droplets) explained in FIG. 6 vary based on the above-described mechanism in accordance with the state of the processing liquid 23 applied to the recording medium 21. That is, it is possible to associate the state of the processing liquid 23 applied to the recording medium 21 (the state such as a flocculant distribution in the thickness direction of the recording medium 21), further the state of the processing liquid 23 applied to the recording medium 21 (the state such as the degree of viscosity, the flocculant content, and the quantity of the processing liquid 23 applied) with the state of a single ink dot and the state of two adjacent ink dots. This associated relation information may be acquired from experiments by sequentially changing the state of the applied processing liquid 23 in the inkjet recording device 1 and capturing formed ink dots or may be acquired from experiments by using an undepicted observation device outside the inkjet recording device 1.

Furthermore, the state of a single ink dot and the state of two adjacent ink dots in the relation information are converted into for example numerical feature values. Feature values for the state of a single ink dot include, for example, an ink dot diameter or an outer circumference length of an ink dot. Feature values for the state of two adjacent ink dots include, for example, the size of two ink dots that are in contact or the type of shape pattern. With the above numerical relation information, the relation of the state of a single ink dot and the state of two adjacent ink dots, after the processing liquid 23 is applied to the recording medium 21, to the degree of viscosity of the processing liquid 23 adjusted by the processing-liquid adjusting unit 12, the flocculant content, and the quantity for application is obtained as numerical information. Furthermore, the relation information may be information having any format as long as the information relates the state of the processing liquid 23 applied to the recording medium 21 (the state such as the degree of viscosity, the flocculant content, and the quantity of the processing liquid 23 applied) to the state of a single ink dot and the state (feature value) of two adjacent ink dots, and it may be for example a table-format information.

The feature-value calculating unit 303 is a functional unit that calculates the above-described feature value for the state of a single-dot area and an adjacent-dots area retrieved by the retrieving unit 302. The feature-value calculating unit 303 is implemented by using a program executed by the CPU 51 illustrated in for example FIG. 3.

The determining unit 304 is a functional unit that determines whether an image formed by the liquid-droplet ejection control unit 309 has a desired quality (whether each feature value falls within an acceptable range (predetermined range)) based on each feature value of the state of a single-dot area and an adjacent-dots area calculated by the feature-value calculating unit 303. The determining unit 304 is implemented by using a program executed by the CPU 51 illustrated in for example FIG. 3.

The relation between each of the feature values of the state of a single-dot area and an adjacent-dots area and an image quality is previously derived from experiments or on theoretical grounds. Therefore, each of the feature values of the state of a single ink dot and the state of two adjacent ink dots and the image quality based on the state may be previously associated. Thus, to achieve a desired image quality, the appropriate range (acceptable range) within which each of feature values of the state of a single ink dot and the state of two adjacent ink dots need to fall is determinable, and the acceptable range for each feature value is settable in advance.

The correcting unit 305 is a functional unit that, when the determining unit 304 determines that at least any one of the feature values falls outside the acceptable range, refers to the relation information, identifies the state of the applied processing liquid (the degree of viscosity, the flocculant content, and the quantity of the processing liquid applied) with which the state of a single ink dot and the state of two adjacent ink dots indicated by the current feature values are changed into (the feature values of) the ideal state of a single ink dot and of two adjacent ink dots, and makes a correction so as to cause the preprocessing control unit 306 to apply the processing liquid to the recording medium 21, the applied processing liquid having the identified state. That is, the correcting unit 305 corrects the state (the degree of viscosity, the flocculant content, and the quantity of the processing liquid applied) of the processing liquid applied by the preprocessing control unit 306. The correcting unit 305 is implemented by using a program executed by the CPU 51 illustrated in for example FIG. 3.

As described above, while the liquid-droplet ejection control unit 309 continuously performs image forming operation by ejecting the ink 22, at least any one of the feature values of the state of a single ink dot and the state of two adjacent ink dots sometimes falls outside the acceptable range, and in this case, the correcting unit 305 corrects the state (the degree of viscosity, the flocculant content, and the quantity of the processing liquid applied) of the applied processing liquid. A specific correction method is explained with reference to FIG. 6. Assume that, for example, the shape of two adjacent ink dots is changed from the state illustrated in the section (a) of FIG. 6, a section (b) of FIG. 6, or a section (d) of FIG. 6 to almost the state in a section (e) of FIG. 6 with time. It is considered that this occurs because the processing liquid 23 is permeated in a deeper position in the recording medium 21 or a small quantity of flocculant is present in the recording medium 21, as compared with the ideal state of the applied processing liquid 23. Therefore, the correcting unit 305 may correct the state (the degree of viscosity, the flocculant content, and the quantity of the processing liquid applied) of the processing liquid applied by the preprocessing control unit 306 and perform processing so that the state of the applied processing liquid 23 becomes an ideal state. FIG. 6 proves that a large quantity of flocculant present in the recording medium 21 and the flocculant unevenly distributed on the surface of the recording medium 21 form the ideal shape of ink dots.

Furthermore, a combination of the state of the processing liquid 23, such as the degree of viscosity, the flocculant content, and the quantity for application, and each of the feature values of the state of a single ink dot and the state of two adjacent ink dots in the above-described relation information is a combination of discrete numerical values. In this case, when the feature values of the state of a single-dot area and an adjacent-dots area, calculated by the feature-value calculating unit 303, do not match any numerical value among the above-described discrete numerical values, for example, the correcting unit 305 may estimate the state of the processing liquid 23, such as the degree of viscosity, the flocculant content, or the quantity for application, which corresponds to the feature value that does not match the above-described discrete numerical values based on the relation between a feature value that is included in the relation information and is in the vicinity of the corresponding feature value and the state of the processing liquid 23, such as the degree of viscosity, the flocculant content, and the quantity for application, which corresponds to the feature value.

The preprocessing control unit 306 is a functional unit that controls an operation performed by the processing-liquid adjusting unit 12 to adjust the state of the processing liquid 23 (the degree of viscosity, the flocculant content, and the quantity of the processing liquid applied) applied by the surface processing unit 5. The preprocessing control unit 306 is implemented by using the preprocessing control unit 64 illustrated in FIG. 3.

The capturing control unit 307 is a functional unit that controls capturing operation (capturing timing, or the like) of the capturing unit 11 that captures images formed by the head unit 7. The capturing control unit 307 is implemented by using the capturing control unit 65 illustrated in FIG. 3.

The movement control unit 308 is a functional unit that controls operation to move the recording medium 21 in the conveying direction. The movement control unit 308 is implemented by using the conveying-motor drive unit 62 illustrated in FIG. 3.

The liquid-droplet ejection control unit 309 is a functional unit that controls operation performed by the head unit 7 to eject liquid droplets of the ink 22. The liquid-droplet ejection control unit 309 is implemented by using the head-drive control unit 61 illustrated in FIG. 3.

The storage unit 310 is a functional unit that stores image data, print data, setting information, programs, the relation information described later, and the like. The storage unit 310 is implemented by using the storage 170 illustrated in FIG. 3.

Furthermore, all or some of the acquiring unit 301, the retrieving unit 302, the feature-value calculating unit 303, the determining unit 304, and the correcting unit 305 do not need to be software programs, but they may be implemented as a hardware circuit such as FPGA (field-programmable gate array) or ASIC.

Furthermore, each functional unit illustrated in FIG. 4 is a conceptual illustration of a function, and this configuration is not a limitation. For example, multiple functional units illustrated as independent functional units in FIG. 4 may be configured as a single functional unit. Moreover, the function provided in a single functional unit of FIG. 4 may be divided so that they are configured as multiple functional units.

Flow of a Correction Process by the Inkjet Recording Device

Figure 7:
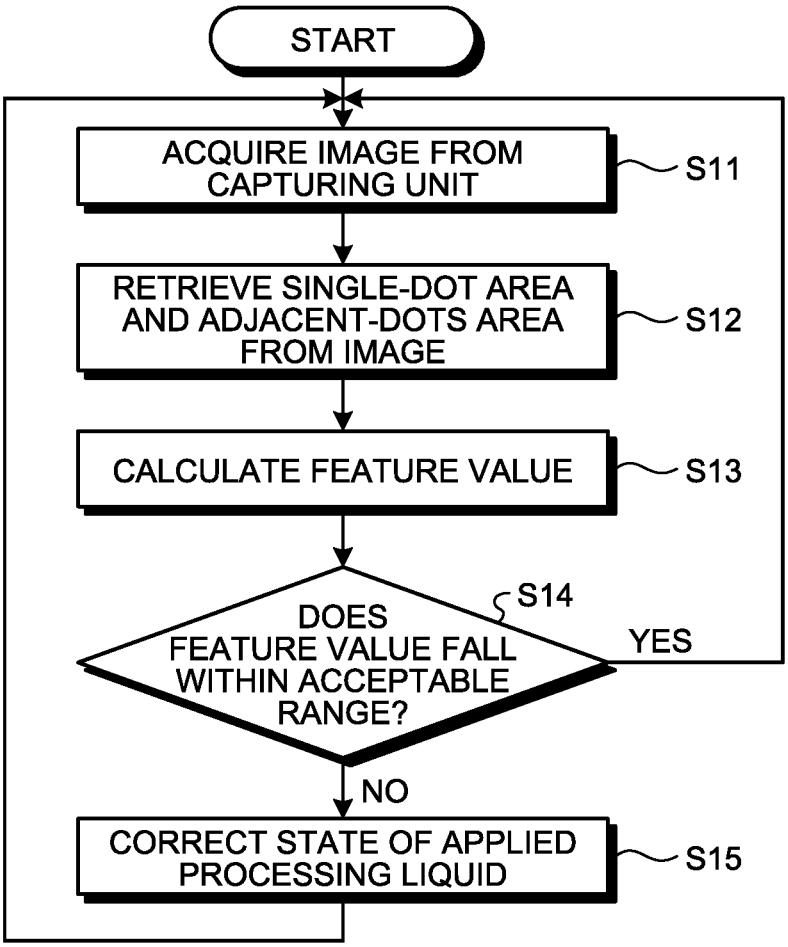
FIG. 7 is a flowchart that illustrates an example of a correction process by the inkjet recording device according to the embodiment.

FIG. 7 is a flowchart that illustrates an example of a correction process by the inkjet recording device according to the embodiment. With reference to FIG. 7, the flow of a correction process by the inkjet recording device 1 according to the present embodiment is explained. The correction process is based on the assumption that operations to convey the recording medium 21 by the movement control unit 308, apply the processing liquid 23 by the preprocessing control unit 306, and eject the ink 22 by the liquid-droplet ejection control unit 309 have been performed.

Step S11

The acquiring unit 301 of the inkjet recording device 1 acquires, via the I/O 55, a capture image representing ink dots constituting an image formed by the head unit 7 and captured by the capturing unit 11. Then, the process proceeds to Step S12.

Step S12

The retrieving unit 302 of the inkjet recording device 1 retrieves a single-dot area and an adjacent-dots area from the capture image acquired by the acquiring unit 301. Then, the process proceeds to Step S13.

Step S13

The feature-value calculating unit 303 of the inkjet recording device 1 calculates each feature value of the state of a single-dot area and an adjacent-dots area retrieved by the retrieving unit 302. Then, the process proceeds to Step S14.

Step S14

The determining unit 304 of the inkjet recording device 1 determines whether an image formed by the liquid-droplet ejection control unit 309 has a desired quality (each feature value falls within an acceptable range) based on each of the feature values of the state of a single-dot area and an adjacent-dots area calculated by the feature-value calculating unit 303. When all of the feature values fall within the acceptable range (Step S14: Yes), the process returns to Step S11 and is repeated again from acquisition of a capture image by the acquiring unit 301. Conversely, when at least any one of the feature values falls outside the acceptable range (Step S14: No), the process proceeds to Step S15.

Step S15

The correcting unit 305 of the inkjet recording device 1 refers to the relation information, identifies the state of the applied processing liquid (the degree of viscosity, the flocculant content, and the quantity of the processing liquid applied) with which the state of a single ink dot and the state of two adjacent ink dots indicated by the current feature values are changed into (the feature values of) the ideal states of a single ink dot and two adjacent ink dots, and makes a correction so as to cause the preprocessing control unit 306 to apply the processing liquid to the recording medium 21, the applied processing liquid having the identified state. That is, the correcting unit 305 corrects the state of the processing liquid (the degree of viscosity, the flocculant content, and the quantity of the processing liquid applied) applied by the preprocessing control unit 306. Then, the process returns to Step S11 and is repeated again from acquisition of a capture image by the acquiring unit 301.

The correction process is performed by the inkjet recording device 1 in the above flow from Step S11 to S15.

As described above, the inkjet recording device 1 according to the present embodiment stores the relation information indicating that the quantity of flocculant in a recording medium and its distribution change depending on differences in the state of the applied processing liquid (the state such as the degree of viscosity, the flocculant content, and the quantity of the processing liquid applied) and accordingly the state of an ink dot changes. Furthermore, the state of the applied processing liquid (the degree of viscosity, the flocculant content, and the quantity of the processing liquid applied, and the like) for obtaining the ideal state of an ink dot is determined by using the relation information based on the state of an ink dot (the state of a single ink dot, the state of two adjacent ink dots, or the like) from a capture image acquired by capturing a recording medium with an image formed thereon. Then, a correction is performed to apply a processing liquid to a recording medium, the applied processing liquid having the determined state. This allows correction for the state of the applied processing liquid to obtain the ideal state of an ink dot even though the image quality is likely to be degraded during image forming operation, thereby achieving proper adjustment on the state of the processing liquid applied during preprocessing and formation of high-quality images. Furthermore, as the above-described relation information is stored, the state of the applied processing liquid for obtaining the ideal state of an ink dot is determinable without retrieving the state of the applied processing liquid through trial and error.

Furthermore, as well as relating the state of the applied processing liquid (the state, such as the degree of viscosity, the flocculant content, and the quantity of the processing liquid applied) with the state of a single ink dot and the state of two adjacent ink dots, the relation information may further relate the type of recording medium, the type of ink, the type of processing liquid, and the like. This allows correction on the state of the applied processing liquid with high accuracy to obtain the ideal state of an ink dot in accordance with the type of recording medium, ink, or processing liquid.

Furthermore, the correcting unit 305 may update the relation information based on the state of an ink dot indicated by an image captured after a processing liquid is applied, the applied processing liquid having the corrected state.

Furthermore, in explanation according to the present embodiment, the inkjet recording device 1 is of a line head type; however, this is not a limitation, and what is called a serial type inkjet recording device may be used.

Moreover, in explanation, a recording medium used by the inkjet recording device 1 according to the present embodiment is a permeable recording medium, to which a processing liquid is permeated; however, impermeable recording media may be used.

Furthermore, according to the above-described embodiment, when at least any one of the functional units of the inkjet recording device 1 is implemented by executing a program, the program is provided by being stored in a ROM, or the like. A configuration may be such that the program executed by the inkjet recording device 1 according to the above-described embodiment is provided by being recorded, in the form of a file that is installable and executable, in a recording medium readable by a computer, such as a CD-ROM (compact disk read only memory), a flexible disk (FD), a CD-R (compact disk recordable), or a DVD (digital versatile disk). Furthermore, a configuration may be such that the program executed by the inkjet recording device 1 according to the above-described embodiment is stored in a computer connected via a network such as the Internet and provided by being downloaded via the network. Moreover, a configuration may be such that the program executed by the inkjet recording device 1 according to the above-described embodiment is provided or distributed via a network such as the Internet. The program executed by the inkjet recording device 1 according to the above-described embodiment has a modular configuration that includes at least any of the above-described functional units, and in terms of actual hardware, the CPU 51 reads the program from the above-described storage device (the ROM 52 or the storage 170) and executes it so as to load and generate the above-described functional units into a main storage device (e.g., the RAM 53).

The present embodiments enable proper correction on the state of the processing liquid applied during preprocessing and formation of high-quality images.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid ejection device that performs preprocessing to apply a processing liquid from an applying unit to a recording medium before ejecting a liquid droplet onto the recording medium to form an image, the liquid ejection device comprising:

an acquiring unit that acquires a capture image that is of an image formed on the recording medium and that is captured by a capturing unit;

a calculating unit that determines a diameter of a single liquid drop of the capture image and an interference amount of two adjacent liquid drops of the capture image; and a correcting unit that corrects a concentration of a flocculant in the processing liquid based on the diameter of the single liquid drop and the interference amount of the two adjacent liquid drops in the capture image.

2. The liquid ejection device according to claim 1, further comprising:

a retrieving unit that retrieves the capture image acquired by the acquiring unit for analysis;

a determining unit that determines whether at least one of the diameter and the interference amount determined by the calculating unit falls within a predetermined range, wherein when the determining unit determines that at least one of the diameter and the interference amount falls outside the predetermined range, the correcting unit changes the concentration of the flocculant in the processing liquid.

3. The liquid ejection device according to claim 1, wherein the correcting unit decreases the concentration of the flocculant in the processing liquid in response to a determination that at least one of: the diameter of the single liquid drop is larger than a maximum diameter threshold, and the interference amount of the two adjacent liquid drops is smaller than a minimum interference amount, and the correcting unit increases the concentration of the flocculant in the processing liquid in response to a determination that at least one of: the diameter of the single liquid drop is smaller than a minimum diameter threshold, and the interference amount of the two adjacent liquid drops is larger than a maximum interference amount.

4. The liquid ejection device according to claim 1, further comprising a storage unit that stores relation information associating a state of the liquid droplet and a state of the processing liquid applied by the applying unit, wherein the correcting unit refers to the relation information and changes the concentration of the flocculant in the processing liquid based on the relation information.

5. The liquid ejection device according to claim 4, wherein when the relation information does not include a state of the liquid droplet indicated by the capture image, the correcting unit estimates the state of the processing liquid based on a relation, in the relation information, between a state in a vicinity of the state of the liquid droplet and a state of the processing liquid applied by the applying unit and corresponding to the state in the vicinity.

6. The liquid ejection device according to claim 1, wherein the correcting unit corrects a quantity of the processing liquid applied by the applying unit.

7. The liquid ejection device according to claim 1, wherein the recording medium is a permeable medium, inside of which the processing liquid permeates.

8. A liquid ejection method for a liquid ejection device that performs preprocessing to apply a processing liquid from an applying unit to a recording medium before ejecting a liquid droplet onto the recording medium to form an image, the liquid ejection method comprising:

acquiring a capture image that is of an image formed on the recording medium and that is captured by a capturing unit;

determining a diameter of a single liquid drop of the capture image and an interference amount of two adjacent liquid drops of the capture image; and correcting a concentration of a flocculant in the processing liquid based on the diameter of the single liquid drop and the interference amount of the two adjacent liquid drops in the capture image.

9. A non-transitory computer-readable recording medium that contains a computer program codes for a liquid ejection device that performs preprocessing to apply a processing liquid from an applying unit to a recording medium before ejecting a liquid droplet onto the recording medium to form an image, performed by a computer, the program codes when executed causing the computer to execute:

acquiring a capture image that is of an image formed on the recording medium and that is captured by a capturing unit;

determining a diameter of a single liquid drop of the capture image and an interference amount of two adjacent liquid drops of the capture image; and correcting a concentration of a flocculant in the processing liquid based on the diameter of the single liquid drop and the interference amount of the two adjacent liquid drops in the capture image.

* * * * *